US007406933B2

(12) United States Patent
Inoue et al.

(10) Patent No.: US 7,406,933 B2
(45) Date of Patent: Aug. 5, 2008

(54) VARIABLE VALVE TIMING APPARATUS WITH REDUCED POWER CONSUMPTION AND CONTROL METHOD THEREOF

(75) Inventors: Yasumichi Inoue, Toyota (JP); Zenichiro Mashiki, Nisshin (JP); Noboru Takagi, Toyota (JP); Haruyuki Urushihata, Chiryu (JP)

(73) Assignees: Toyota Jidosha Kabushiki Kaisha, Aichi-ken (JP); Denso Corporation, Aichi-ken (JP)

( * ) Notice: Subject to any disclaimer, the term of this patent is extended or adjusted under 35 U.S.C. 154(b) by 0 days.

(21) Appl. No.: 11/691,078

(22) Filed: Mar. 26, 2007

(65) Prior Publication Data

US 2007/0227482 A1 Oct. 4, 2007

(30) Foreign Application Priority Data

Mar. 28, 2006 (JP) ..... 2006-087576

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31

See application file for complete search history.

(56) References Cited

U.S. PATENT DOCUMENTS 5,957,095 A * 9/1999 Kako ..... 123/90.15

FOREIGN PATENT DOCUMENTS

| | | |
|---|---|---|
| JP | 2003-184585 A | 7/2003 |
| JP | 2004-156508 A | 6/2004 |
| JP | 2005-146993 A | 6/2005 |
| JP | 2005-180307 A | 7/2005 |

* cited by examiner

*Primary Examiner*—Zelalem Eshete
(74) *Attorney, Agent, or Firm*—Sughrue Mion, PLLC

(57) ABSTRACT

A convergence determination of intake valve phase control is made by comparing a phase deviation of an intake valve from a target phase with a convergence determination value. At the time of convergence, it is determined that the intake valve phase has reached the target phase, so that the required phase-change amount of a camshaft is set to zero and therefore the actuator operation amount is also set to zero. At the time of engine stop when the target phase has a fixed value, after convergence of the intake valve phase control, the operation of the actuator is stopped. In addition, during the course of engine stop, the convergence determination value is set to be switched from the time of engine operation so that the convergence determination of the intake valve phase control is made in more relaxed conditions compared with at the time of engine operation.

12 Claims, 12 Drawing Sheets

VARIABLE VALVE TIMING APPARATUS WITH REDUCED POWER CONSUMPTION AND CONTROL METHOD THEREOF

This nonprovisional application is based on Japanese Patent Application No. 2006-087576 filed with the Japan Patent Office on Mar. 28, 2006, the entire contents of which are hereby incorporated by reference.

BACKGROUND OF THE INVENTION

1. Field of the Invention

The present invention relates to a variable valve timing apparatus and more particularly to a variable valve timing apparatus having a mechanism changing an opening/closing timing of a valve at an amount of change according to an operation amount of an actuator.

2. Description of the Background Art

VVT (Variable Valve Timing) has conventionally been known that changes the phase (crank angle) in (at) which an intake valve or an exhaust valve is opened/closed, according to an operating condition. Generally, a variable valve timing apparatus changes the phase by rotating, relative to a sprocket or the like, a camshaft that drives the intake valve or exhaust valve to open/close. The camshaft is rotated by such an actuator as hydraulic or electric motor.

Such a variable valve timing apparatus may be operated not only at the time of engine operation but also at the time of engine stop to change a valve timing (camshaft phase). Specifically, in the case where the valve timing at the time of engine stop differs from the valve phase suitable for the next engine start, the valve timing is changed by the variable valve timing apparatus during engine stop, in preparation for the next engine start (for example, Patent Documents 1-4).

Patent Document 1 (Japanese Patent Laying-Open No. 2003-184585) discloses that, immediately after the automatic stop of the engine, the valve opening/closing conditions (valve lift amount, valve timing, and the like) are controlled so that the conditions are suitable for the next engine automatic starting, which are estimated based on the coolant temperature and the like at this point of time, and an operation of a variable valve lift mechanism or the like is thereafter stopped. On the other hand, Patent Document 2 (Japanese Patent Laying-Open No. 2005-180307) and Patent Document 3 (Japanese Patent Laying-Open No. 2005-146993) discloses a valve timing control apparatus in which a rotational phase is naturally returned to an intermediate phase between the most retarded angle phase and the most advanced angle phase at the time of inertial rotation during engine start or after engine stop whereby the rotational phase at which the engine can be started can be set at the intermediate phase.

Further, Patent Document 4 (Japanese Patent Laying-Open No. 2004-156508) discloses a valve timing control apparatus that changes a valve timing to the angular position suitable for the next engine start by supplying electric current to a hysteresis brake as an electromagnetic actuator for a prescribed period of time after turning off an ignition key, namely after engine stop.

In general, operation energy to an actuator for a variable valve timing apparatus at the time of engine stop is supplied from a secondary battery charged when the engine operates. Therefore, in the configuration in which the actuator is operated to change the valve timing at the time of engine stop, the power consumption therefore should be restrained. However, Patent Documents 1-3 do not mention the power consumption of the actuator in changing the valve timing at the time of engine stop.

On the other hand, the valve timing control apparatus disclosed in Patent Document 4 can prevent exhaustion of the battery to some extent by limiting the period of power supply to the electromagnetic actuator (hysteresis brake) after engine stop to a certain range. However, although the amount of change of the valve timing required at the time of engine stop differs depending on the valve timing at the time of engine stop, the aforementioned power supply period is fixedly set and therefore power supply to the electromagnetic actuator is continued even in the period after the valve timing is changed to the valve timing suitable for the next engine start, possibly resulting in unnecessary power consumption.

SUMMARY OF THE INVENTION

An object of the present invention is to provide a variable valve timing apparatus in which power consumption resulting from valve timing control during the course of engine stop can be reduced.

A variable valve timing apparatus in accordance with the present invention changes an opening/closing timing of at least any one of an intake valve and an exhaust valve provided to an engine. The variable valve timing apparatus includes an actuator, a change mechanism and an actuator operation amount setting portion. The change mechanism changes the opening/closing timing by changing difference in rotational phase difference of a camshaft driving the valve having the opening/closing timing changed, from a rotational phase of a crankshaft, at an amount of change according to an operation amount of the actuator. The actuator operation amount setting portion sets the operation amount of the actuator, based on a deviation between the opening/closing timing at present of the valve having the opening/closing timing changed and a target value thereof. The actuator operation amount setting portion includes a convergence determination portion and a determination value switching portion. The convergence determination portion sets the operation amount of the actuator to approximately zero, when an absolute value of the deviation is equal to or smaller than a determination value. The determination value switching portion sets the determination value in the convergence determination portion at a value larger than the determination value in changing the opening/closing timing at a time of engine operation.

Alternatively, a variable valve timing apparatus in accordance with a present invention changes an opening/closing timing of at least any one of an intake valve and an exhaust valve provided to an engine. The variable valve timing apparatus includes an actuator, a change mechanism and a control unit. The change mechanism changes the opening/closing timing by changing difference in rotational phase of a camshaft driving the valve having the opening/closing timing changed, from a rotational phase of a crankshaft, at an amount of change according to an operation amount of the actuator. The control unit sets the operation amount of the actuator, based on a deviation between the opening/closing timing at present of the valve having the opening/closing timing changed and a target value thereof. The control unit sets the operation amount of the actuator to approximately zero, when an absolute value of the deviation is equal to or smaller than a determination value, and in addition, in changing the opening/closing timing during a course of engine stop, sets the determination value at a value larger than the determination value in changing the opening/closing timing at a time of engine operation.

In accordance with the present invention, a control method of a variable valve timing apparatus is provided. The variable valve timing apparatus changes an opening/closing timing of at least any one of an intake valve and an exhaust valve provided to an engine. The variable valve timing apparatus includes an actuator and a change mechanism. The change mechanism changes the opening/closing timing by changing difference in rotational phase of a camshaft driving the valve having the opening/closing timing changed, from a rotational phase of a crankshaft, at an amount of change according to an operation amount of the actuator. The control method includes a convergence determination step and a determination value switching step. At the convergence determination step, the operation amount of the actuator is set to approximately zero, when an absolute value of the deviation is equal to or smaller than a determination value. At the determination value switching step, in changing the opening/closing timing during a course of engine stop, the determination value at the convergence determination step is set at a value larger than the determination value in changing the opening/closing timing at a time of engine operation.

According to the variable valve timing apparatus or the control method thereof as described above, during the course of engine stop, in particular after engine stop, when the difference between the actual valve opening/closing timing (actual valve timing) and the target value becomes equal to or lower than a determination value, it is determined that the actual valve timing has reached the target value so that the operation amount of the actuator can be set to zero. Here, the determination value may be set relatively larger during the course of engine stop than at the time of engine operation. Therefore, in the valve timing control during the course of engine stop, too much accuracy is not required in the valve timing setting, and the operation of the actuator is stopped after the actual valve timing reaches the target value, thereby preventing unnecessary power consumption after that. Accordingly, power consumption resulting from the valve timing control during the course of engine stop can be reduced.

It is noted that the period of time in which the aforementioned determination value is set at a value larger than at the time of engine operation may be a period after the engine is actually stopped or may include a period during a process of stopping engine (a period of time from generation of an engine stop command to the actual engine stop) and a period after the actual engine stop.

Preferably, the variable valve timing apparatus according to the present invention further includes a power supply stopping portion stops power supply to the actuator when the absolute value of the deviation becomes equal to or smaller than the determination value, in changing the opening/closing timing during the course of engine stop. Alternatively, the control unit gives an instruction to stop power supply to the actuator when an absolute value of the deviation becomes equal to or smaller than the determination value, in changing the opening/closing timing during the course of engine stop.

Preferably, the control method of a variable valve timing apparatus further includes a power supply stopping step. At the power supply stopping step, power supply to the actuator is stopped when an absolute value of the deviation becomes equal to or smaller than the determination value, in changing the opening/closing timing during the course of engine stop.

According to the variable valve timing apparatus as described above, in the valve timing control during the course of engine stop, power supply to the actuator is stopped after the actual valve timing reaches the target value, thereby preventing unnecessary power consumption after that, more reliably.

Preferably, in the variable valve timing apparatus or the control method thereof according to the present invention, the actuator is formed of an electric motor and the operation amount of the actuator is a rotational speed difference of the electric motor relative to the camshaft. The change mechanism changes the opening/closing timing such that a ratio between the operation amount of the actuator and the amount of change of the opening/closing timing differs and a change direction of the opening/closing timing is identical, between a case where the opening/closing timing is in a first region and a case where the opening/closing timing is in a second region.

According to the variable valve timing apparatus or the control method thereof as described above, the electric motor is the actuator, and the operation amount of the actuator is the rotational speed difference of the electric motor relative to the camshaft of which rotation is stopped as the engine stops. Because of this configuration, power consumption resulting from the valve timing control during the course of engine stop can be reduced.

Preferably, in the variable valve timing apparatus or the control method thereof according to the present invention, in changing the opening/closing timing during a course of stopping the engine, the target value of the opening/closing timing is set at a prescribed value suitable for a next engine start.

According to the variable valve timing apparatus or the control method thereof as described above, the opening/closing timing change (valve timing control) during the course of engine stop enables a smooth engine start next time.

Therefore, the main advantage of the present invention is to reduce power consumption resulting from the valve timing control during the course of engine stop.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
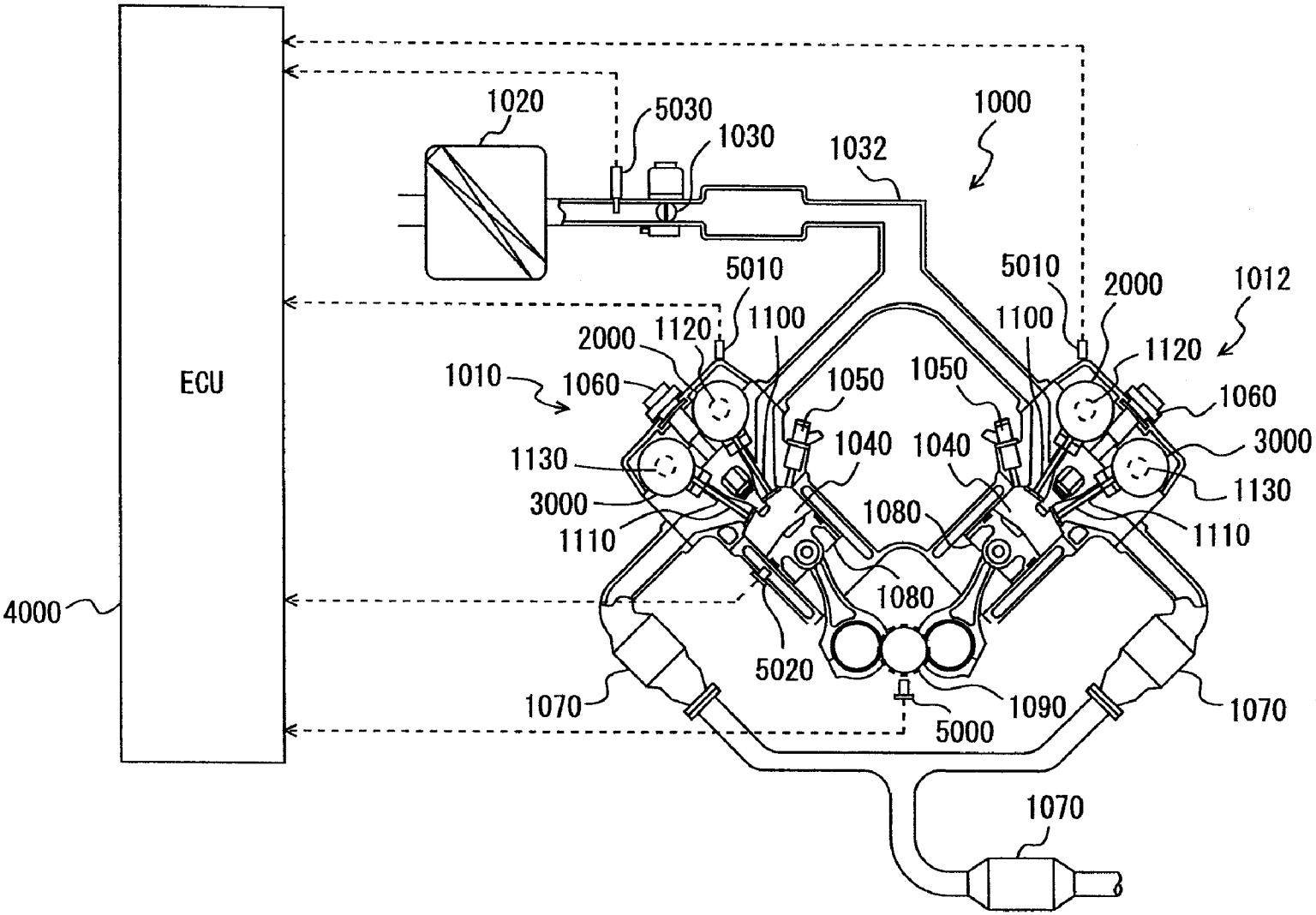
FIG. 1 is a schematic showing a configuration of an engine of a vehicle on which a variable valve timing apparatus is mounted according to an embodiment of the present invention.

With reference to the drawings, an embodiment of the present invention is hereinafter described. In the following description, like components are denoted by like reference characters. They are also named identically and function identically. Therefore, a detailed description thereof is not repeated.

Referring to FIG. 1, a description is given of an engine of a vehicle on which a variable valve timing apparatus is mounted, according to an embodiment of the present invention.

An engine 1000 is a V-type 8-cylinder engine having a first bank 1010 and a second bank 1012 each including a group of four cylinders. Here, the application of the present invention does not limit engine types, and the variable valve timing apparatus as described below is applicable to any engine other than the V8 engine.

Into engine 1000, air is sucked from an air cleaner 1020. The quantity of sucked air is adjusted by a throttle valve 1030. Throttle valve 1030 is an electronic throttle valve driven by a motor.

The air is supplied through an intake manifold 1032 into a cylinder 1040. The air is mixed with fuel in cylinder 1040 (combustion chamber). Into cylinder 1040, the fuel is directly injected from an injector 1050. In other words, injection holes of injector 1050 are provided within cylinder 1040.

The fuel is injected in the intake stroke. The fuel injection timing is not limited to the intake stroke. Further, in the present embodiment, engine 1000 is described as a direct-injection engine having injection holes of injector 1050 that are disposed within cylinder 1040. However, in addition to direct-injection injector 1050, a port injector may be provided. Moreover, only the port injector may be provided.

The air-fuel mixture in cylinder 1040 is ignited by a spark plug 1060 and accordingly burned. The air-fuel mixture after burned, namely exhaust gas, is cleaned by a three-way catalyst 1070 and thereafter discharged to the outside of the vehicle. The air-fuel mixture is burned to press down a piston 1080 and thereby rotate a crankshaft 1090.

At the top of cylinder 1040, an intake valve 1100 and an exhaust valve 1110 are provided. Intake valve 1100 is driven by an intake camshaft 1120. Exhaust valve 1110 is driven by an exhaust camshaft 1130. Intake camshaft 1120 and exhaust camshaft 1130 are coupled by such parts as a chain and gears to be rotated at the same rotational speed (half the rotational speed of crankshaft 1090). Here, the rotational speed of a rotator such as a shaft is commonly represented by revolutions per unit time (typically, revolutions per minute (rpm)).

Intake valve 1100 has its phase (opening/closing timing) controlled by an intake VVT mechanism 2000 provided to intake camshaft 1120. Exhaust valve 1110 has its phase (opening/closing timing) controlled by an exhaust VVT mechanism 3000 provided to exhaust camshaft 1130.

In the present embodiment, intake camshaft 1120 and exhaust camshaft 1130 are rotated by the VVT mechanisms to control respective phases of intake valve 1100 and exhaust valve 1110. Here, the phase control method is not limited to the aforementioned one.

Figure 3:
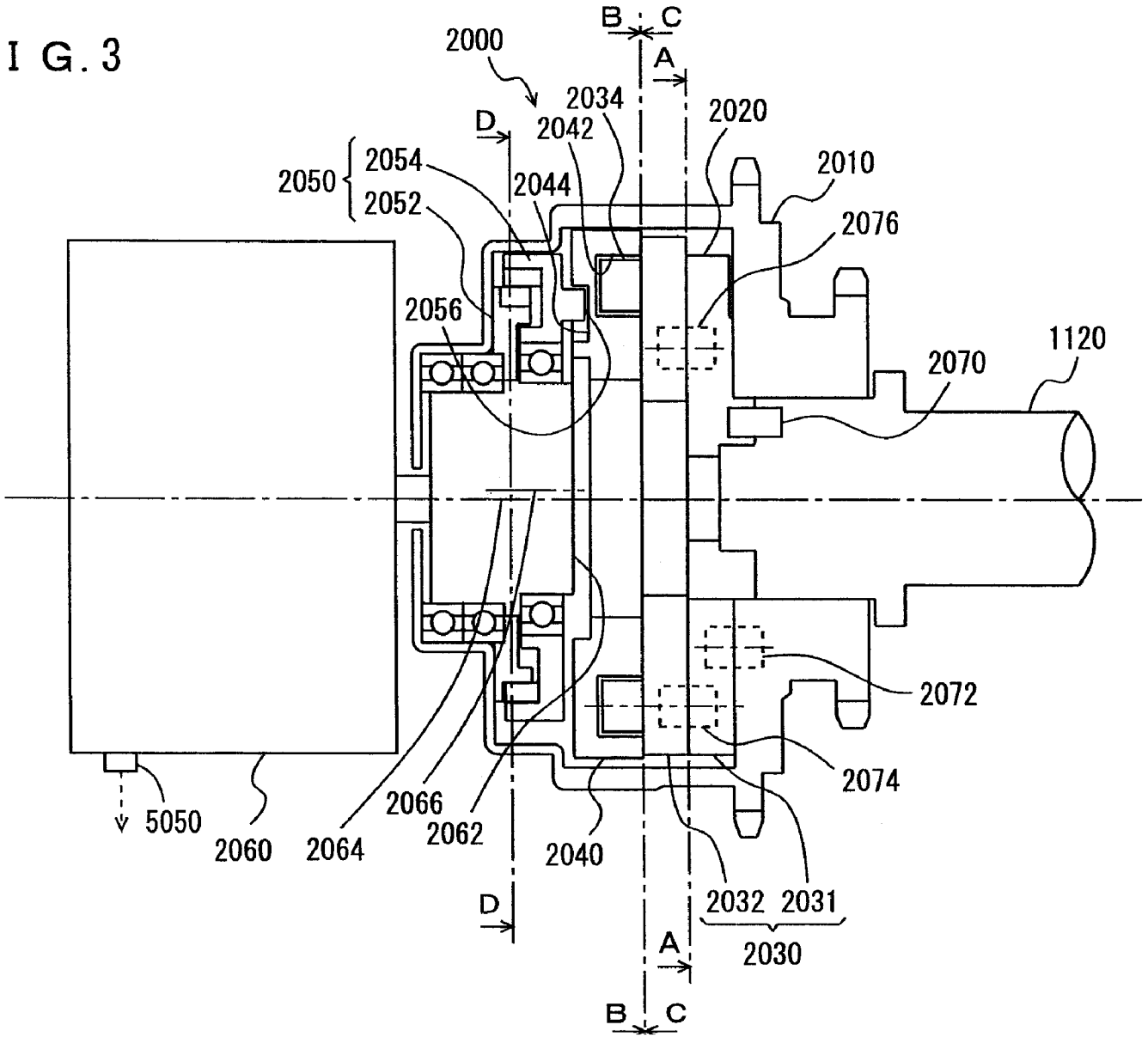
FIG. 3 is a cross section showing an intake VVT mechanism.

Intake VVT mechanism 2000 is operated by an electric motor 2060 (shown in FIG. 3). Electric motor 2060 is controlled by an ECU (Electronic Control Unit) 4000. The current and voltage of electric motor 2060 are detected by an ammeter (not shown) and a voltmeter (not shown) and the measurements are input to ECU 4000.

Exhaust VVT mechanism 3000 is hydraulically operated. Here, intake VVT mechanism 2000 may be hydraulically operated while exhaust VVT mechanism 3000 may be operated by an electric motor.

To ECU 4000, signals indicating the rotational speed and the crank angle of crankshaft 1090 are input from a crank angle sensor 5000. Further, to ECU 4000, signals indicating respective phases of intake camshaft 1120 and exhaust camshaft 1130 (phase: the camshaft position in the rotational direction) are input from a cam position sensor 5010.

Furthermore, to ECU 4000, a signal indicating the water temperature (coolant temperature) of engine 1000 from a coolant temperature sensor 5020 as well as a signal indicating the quantity of intake air (quantity of air taken or sucked into engine 1000) of engine 1000 from an airflow meter 5030 are input.

Based on these signals input from the sensors as well as a map and a program stored in a memory (not shown), ECU 4000 controls the throttle opening position, the ignition timing, the fuel injection timing, the quantity of injected fuel, the phase of intake valve 1100 and the phase of exhaust valve 1110 for example, so that engine 1000 is operated in a desired operating state.

Figure 2:
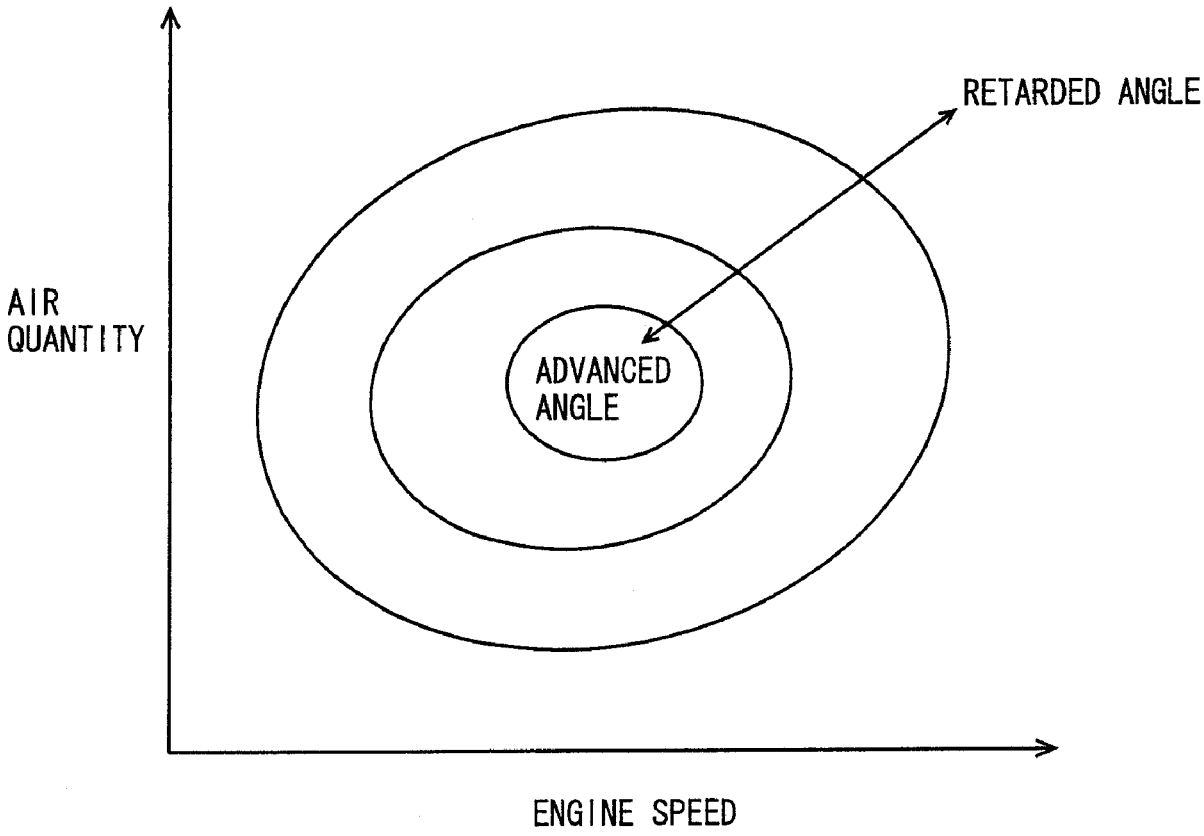
FIG. 2 shows a map defining the phase of an intake camshaft.

In the present embodiment, ECU 4000 determines the phase of intake valve 1100 based on the map as shown in FIG. 2 that uses the engine speed NE and the intake air quantity KL as parameters. A plurality of maps for respective coolant temperatures are stored for determining the phase of intake valve 1100.

In the following, a further description is given of intake VVT mechanism 2000. Here, exhaust VVT mechanism 3000 may be configured identically to intake VVT mechanism 2000 as described below. Moreover, each of intake VVT mechanism 2000 and exhaust VVT mechanism 3000 may be configured identically to intake VVT mechanism 2000 as described below.

As shown in FIG. 3, intake VVT mechanism 2000 includes a sprocket 2010, a cam plate 2020, a link mechanism 2030, a guide plate 2040, a reduction gear 2050, and electric motor 2060.

Sprocket 2010 is coupled via a chain or the like to crankshaft 1090. The rotational speed of sprocket 2010 is half the rotational speed of crankshaft 1090, similarly to intake camshaft 1120 and exhaust camshaft 1130. Intake camshaft 1120 is provided concentrically with the rotational axis of sprocket 2010 and rotatably relative to sprocket 2010.

Cam plate 2020 is coupled to intake camshaft 1120 with a pin (1) 2070. Cam plate 2020 rotates in sprocket 2010, together with intake camshaft 1120. Here, cam plate 2020 and intake camshaft 1120 may be integrated into one unit.

Figure 4:
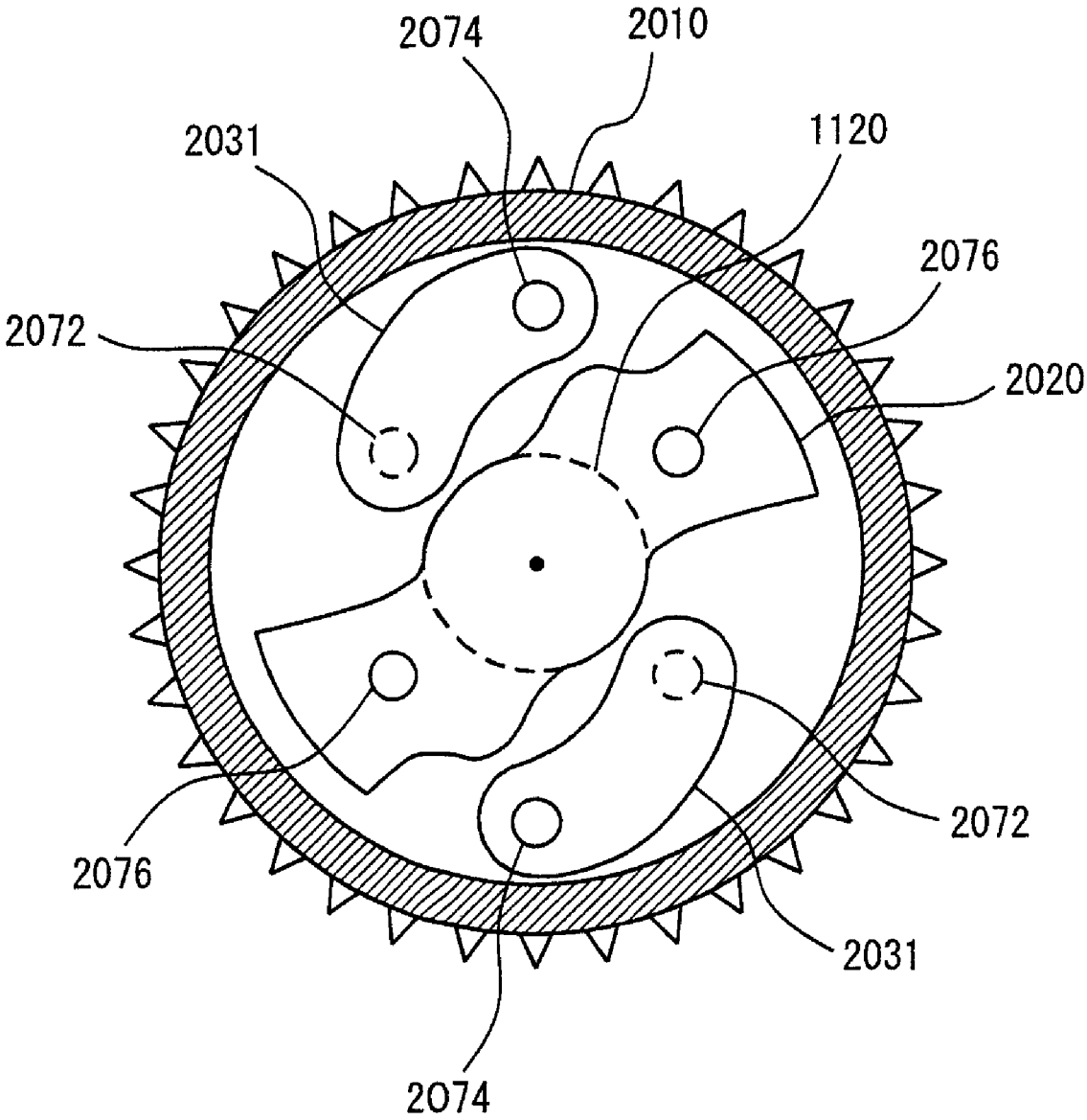
FIG. 4 is a cross section along A-A in FIG. 3.

Link mechanism 2030 is comprised of an arm (1) 2031 and an arm (2) 2032. As shown in FIG. 4 which is a cross section along A-A in FIG. 3, a pair of arms (1) 2031 is provided within sprocket 2010 so that the arms are point symmetric to each other with respect to the rotational axis of intake camshaft 1120. Each arm (1) 2031 is coupled to sprocket 2010 so that the arm can swing about a pin (2) 2072.

Figure 5:
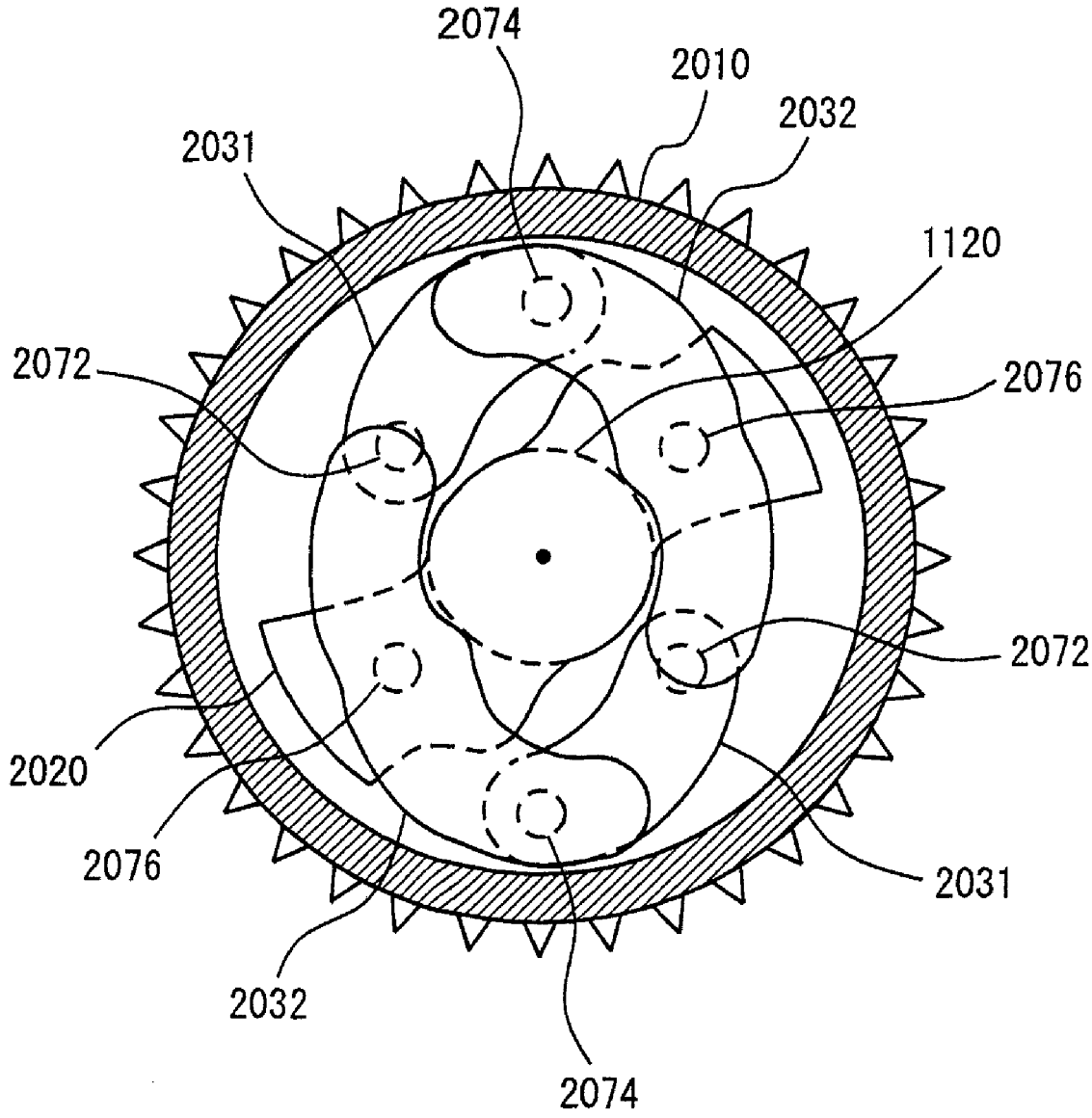
FIG. 5 is a (first) cross section along B-B in FIG. 3.
Figure 6:
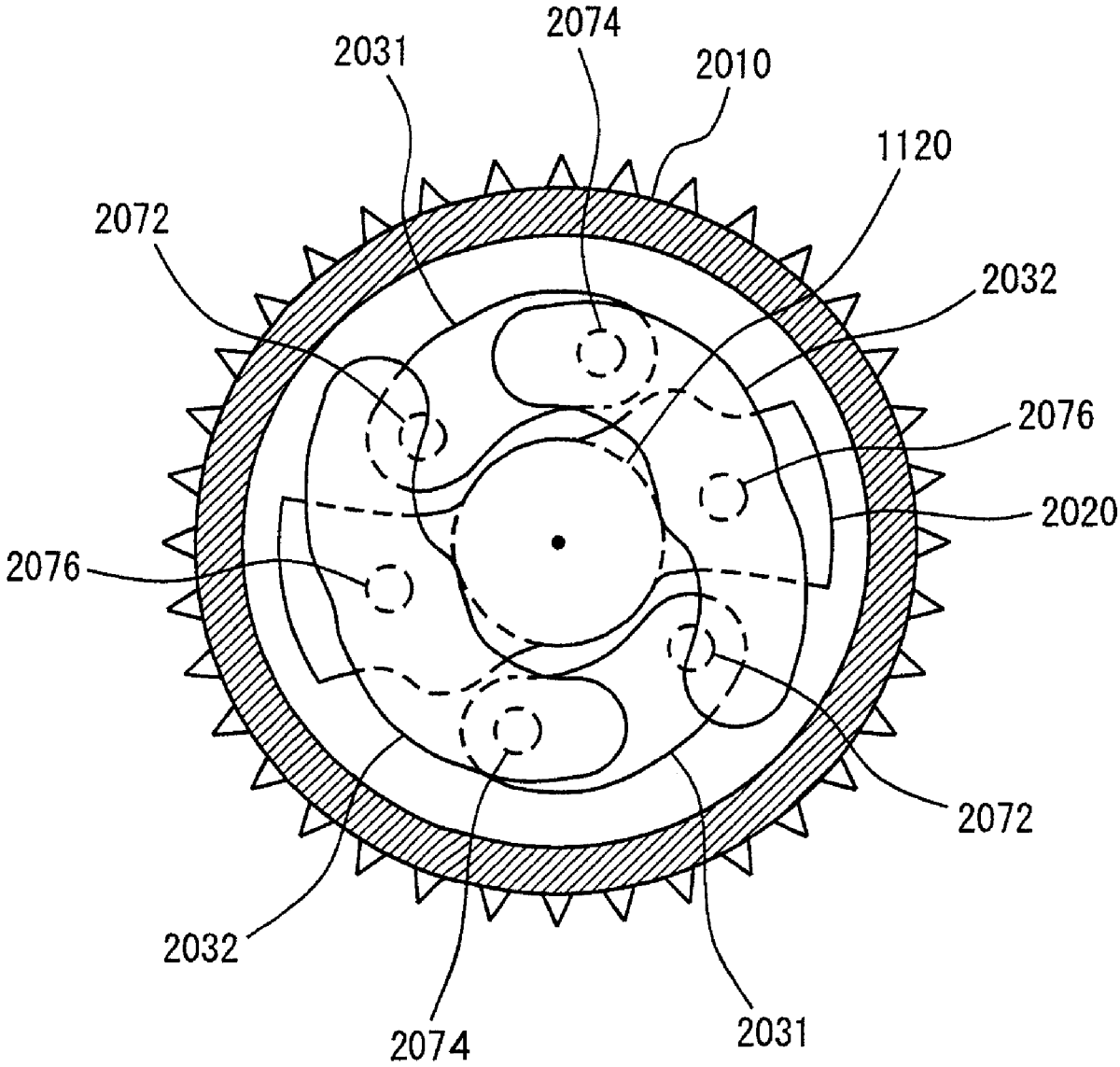
FIG. 6 is a (second) cross section along B-B in FIG. 3.

As shown in FIG. 5 which is a cross section along B-B in FIG. 3 and as shown in FIG. 6 showing the state where the phase of intake valve 1100 is advanced with respect to the state in FIG. 5, arms (1) 2031 and cam plate 2020 are coupled by arms (2) 2032.

Arm (2) 2032 is supported so that the arm can swing about a pin (3) 2074 and with respect to arm (1) 2031. Further, arm (2) 2032 is supported so that the arm can swing about a pin (4) 2076 and with respect to cam plate 2020.

A pair of link mechanisms 2030 causes intake camshaft 1120 to rotate relative to sprocket 2010 and thereby changes the phase of intake valve 1100. Thus, even if one of the paired link mechanisms 2030 is broken as a result of any damage or the like, the other link mechanism can be used to change the phase of intake valve 1100.

Referring back to FIG. 3, at a surface of each link mechanism 2030 (arm (2) 2032) that is a surface thereof facing guide plate 2040, a control pin 2034 is provided. Control pin 2034 is provided concentrically with pin (3) 2074. Each control pin 2034 slides in a guide groove 2042 provided in guide plate 2040.

Each control pin 2034 slides in guide groove 2042 of guide plate 2040, to be shifted in the radial direction. The radial shift of each control pin 2034 causes intake camshaft 1120 to rotate relative to sprocket 2010.

Figure 7:
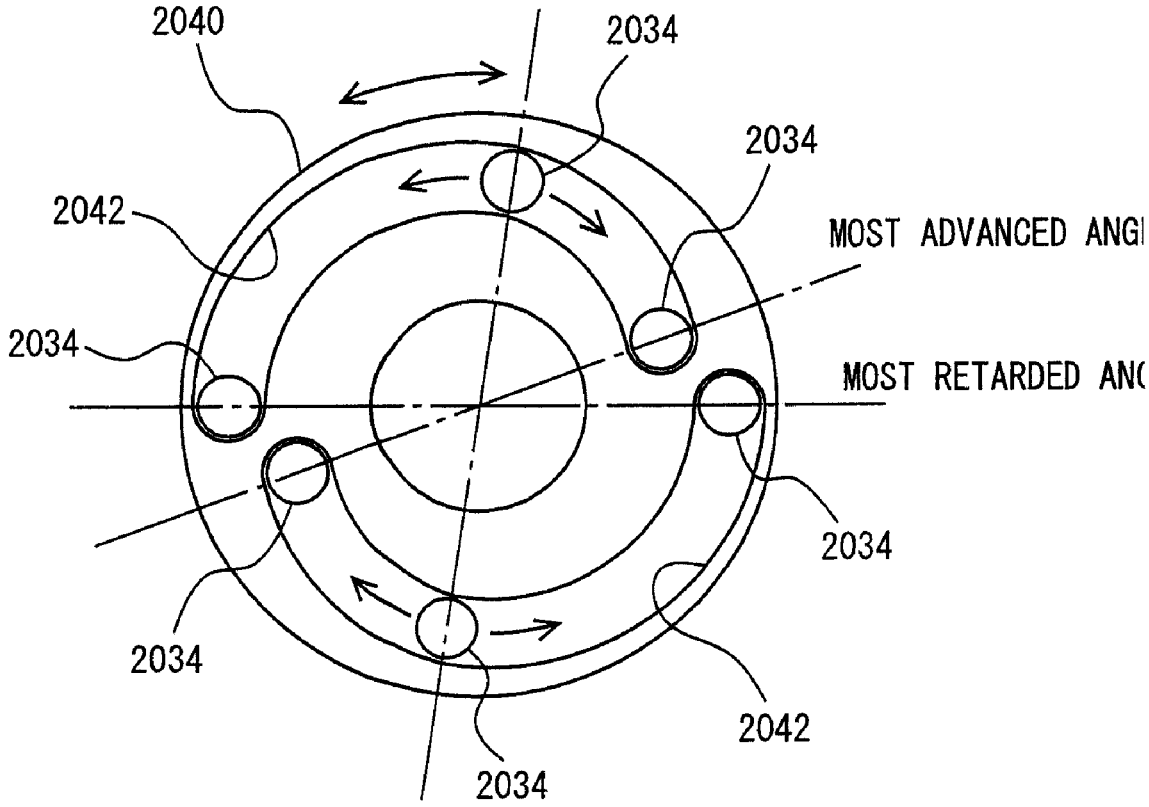
FIG. 7 is a cross section along C-C in FIG. 3.

As shown in FIG. 7 which is a cross section along C-C in FIG. 3, guide groove 2042 is formed in the spiral shape so that rotation of guide plate 2040 causes each control pin 2034 to shift in the radial direction. Here, the shape of guide groove 2042 is not limited to this.

As control pin 2034 is shifted further in the radial direction from the axial center of guide plate 2040, the phase of intake valve 1100 is retarded to a greater extent. In other words, the amount of change of the phase has a value corresponding to the operation amount of link mechanism 2030 generated by the radial shift of control pin 2034. Alternatively, the phase of intake valve 1100 may be advanced to a greater extent as control pin 2034 is shifted further in the radial direction from the axial center of guide plate 2040.

As shown in FIG. 7, when control pin 2034 abuts on an end of guide groove 2042, the operation of link mechanism 2030 is restrained. Therefore, the phase in which control pin 2034 abuts on an end of guide groove 2042 is the phase of the most retarded angle or the most advanced angle.

Referring back to FIG. 3, in guide plate 2040, a plurality of depressed portions 2044 are provided in its surface facing reduction gear 2050, for coupling guide plate 2040 and reduction gear 2050 to each other.

Reduction gear 2050 is comprised of an outer teeth gear 2052 and an inner teeth gear 2054. Outer teeth gear 2052 is fixed with respect to sprocket 2010 so that the gear rotates together with sprocket 2010.

Inner teeth gear 2054 has a plurality of protruded portions 2056 thereon that are received in depressed portions 2044 of guide plate 2040. Inner teeth gear 2054 is supported rotatably about an eccentric axis 2066 of a coupling 2062 formed eccentrically with respect to an axial center 2064 of an output shaft of electric motor 2060.

Figure 8:
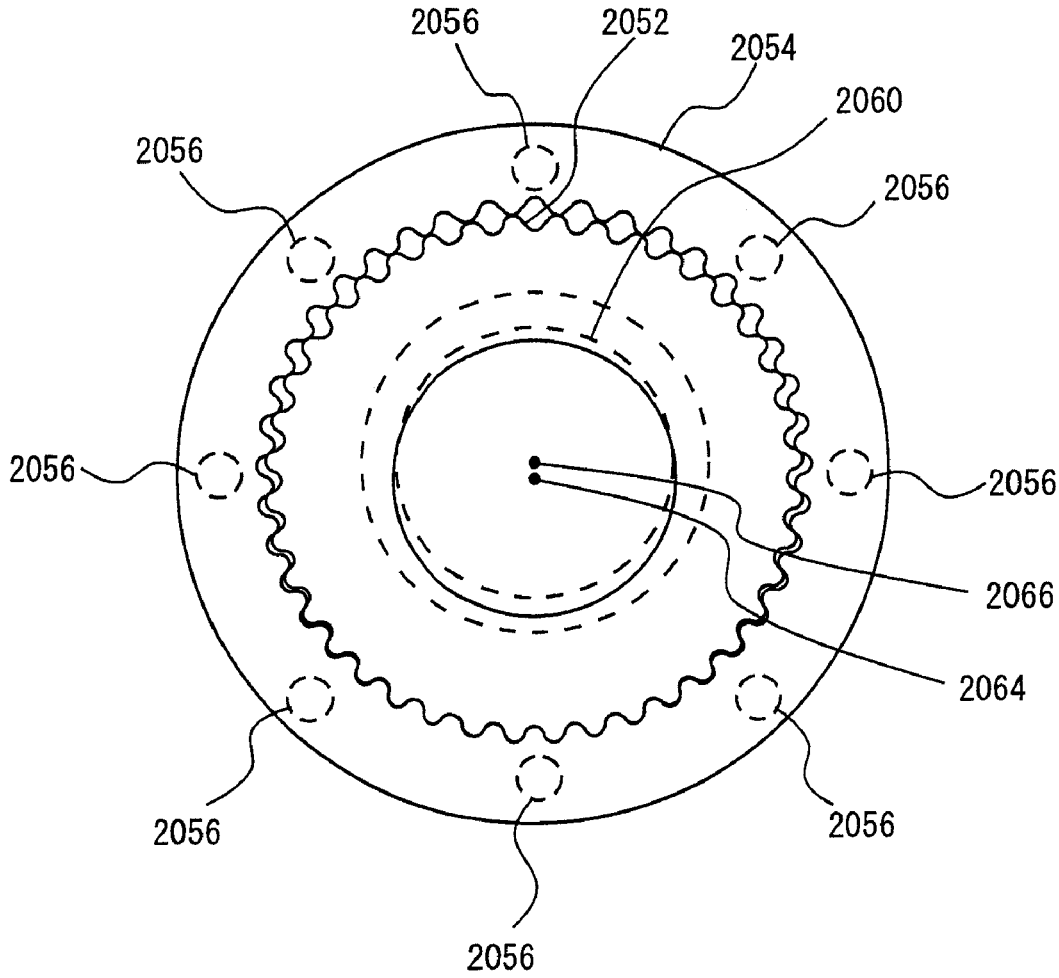
FIG. 8 is a cross section along D-D in FIG. 3.

FIG. 8 shows a cross section along D-D in FIG. 3. Inner teeth gear 2054 is provided such that a part of the teeth thereof meshes with outer teeth gear 2052. In the case where the rotational speed of the output shaft of electric motor 2060 is identical to the rotational speed of sprocket 2010, coupling 2062 and inner teeth gear 2054 rotate at the same rotational speed as that of outer teeth gear 2052 (sprocket 2010). When, guide plate 2040 rotates at the same rotational speed as that of sprocket 2010 and accordingly the phase of intake valve 1100 is maintained.

When electric motor 2060 causes coupling 2062 to rotate about axial center 2064 and relative to outer teeth gear 2052, inner teeth gear 2054 as a whole accordingly revolves about axial center 2064 while inner teeth gear 2054 rotates about eccentric axis 2066. The rotational motion of inner teeth gear 2054 causes guide plate 2040 to rotate relative to sprocket 2010 and thus the phase of intake valve 1100 is changed.

The phase of intake valve 1100 is changed as a result of reduction of the rotational speed of relative rotation between the output shaft of electric motor 2060 and sprocket 2010 (operation amount of electric motor 2060) in reduction gear 2050, guide plate 2040 and link mechanism 2030. Here, the phase of intake valve 1100 may be changed by increasing the rotational speed of relative rotation between the output shaft of electric motor 2060 and sprocket 2010. The output shaft of electric motor 2060 is provided with a motor rotational angle sensor 5050 outputting a signal indicating a rotational angle of the output shaft (the position of the output shaft in the rotational direction). Motor rotational angle sensor 5050 is generally configured to generate a pulse signal every time the output shaft of electric motor 2060 rotates by a prescribed angle. Based on the output from motor rotational angle sensor 5050, the rotational speed of the output shaft of electric motor 2060 (hereinafter, also simply referred to as the rotational speed of electric motor 2060) can be detected.

Figure 9:
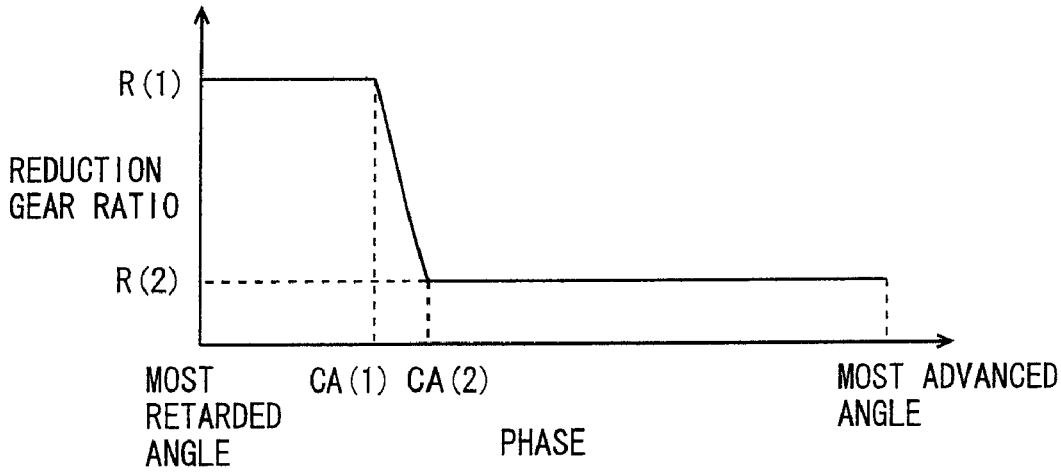
FIG. 9 shows the reduction gear ratio of the intake VVT mechanism as a whole.

As shown in FIG. 9, the reduction gear ratio R (θ) of intake VVT mechanism 2000 as a whole (the ratio of the rotational speed of relative rotation between the output shaft of electric motor 2060 and sprocket 2010 to the amount of the phase-change) may have a value according to the phase of intake valve 1100. In the present embodiment, as the reduction gear ratio is higher, the amount of the phase-change with respect to the rotational speed of relative rotation between the output shaft of electric motor 2060 and sprocket 2010 is smaller.

In the case where the phase of intake valve 1100 is in a first region from the most retarded angle to CA (1), the reduction gear ratio of intake VVT mechanism 2000 as a whole is R (1). In the case where the phase of intake valve 1100 is in a second region from CA (2) (CA (2) is advanced with respect to CA (1)) to the most advanced angle, the reduction gear ratio of intake VVT mechanism 2000 as a whole is R (2) (R (1)>R(2)).

In the case where the phase of intake valve 1100 is in a third region from CA (1) to CA (2), the reduction gear ratio of intake VVT mechanism 2000 as a whole changes at a predetermined rate of change ((R(2)−R(1))/(CA(2)−CA(1)).

The function of intake VVT mechanism 2000 of the variable valve timing apparatus will be described below, which is carried out based on the following structure.

Figure 10:
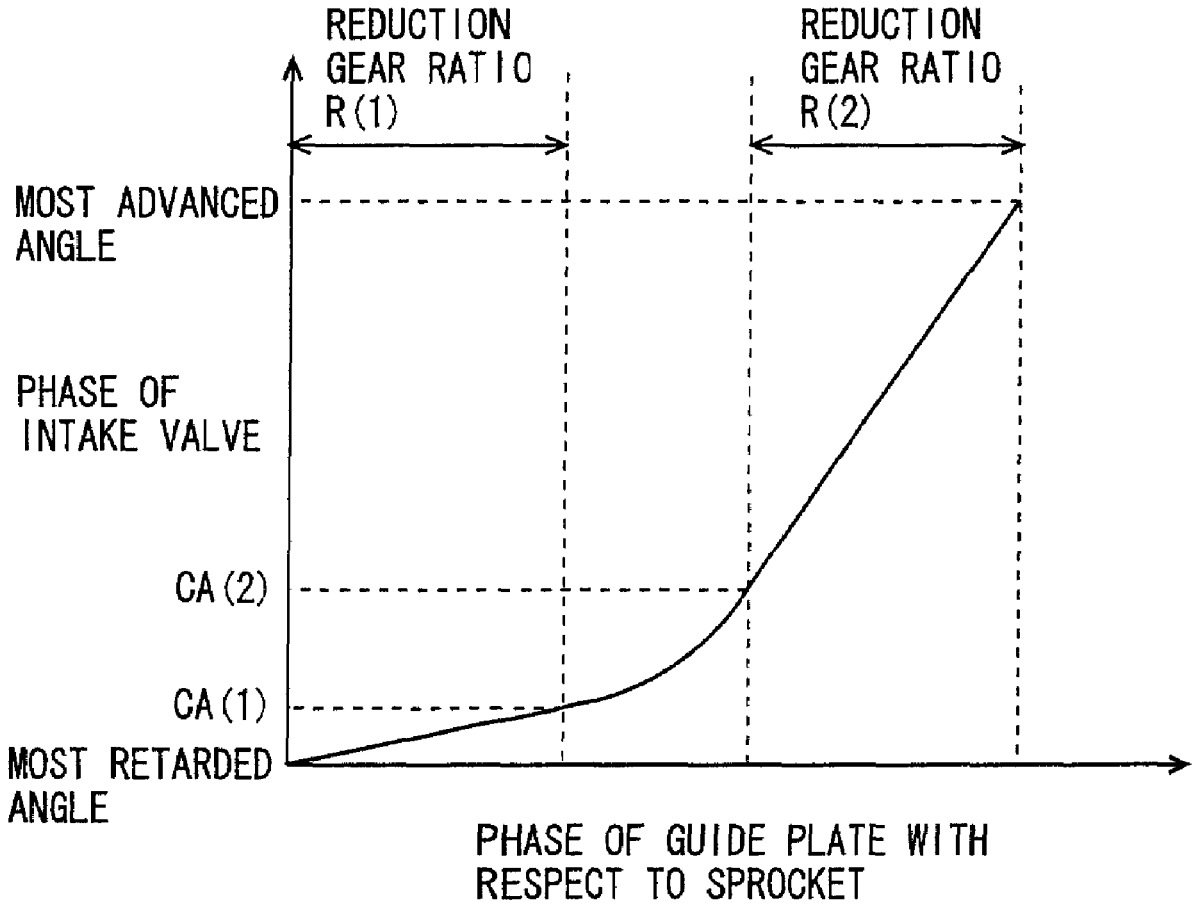
FIG. 10 shows a relation between the phase of a guide plate relative to a sprocket and the phase of the intake camshaft.

When the phase of intake valve 1100 (intake camshaft 1120) is to be advanced, electric motor 2060 is operated to rotate guide plate 2040 relative to sprocket 2010, thereby advancing the phase of intake valve 1100 as shown in FIG. 10.

When the phase of intake valve 1100 is in the first region between the most retarded angle and CA (1), the rotational speed of relative rotation between the output shaft of electric motor 2060 and sprocket 2010 is reduced at reduction gear ratio R (1) to advance the phase of intake valve 1100.

In the case where the phase of intake valve 1100 is in the second region between CA (2) and the most advanced angle, the rotational speed of relative rotation between the output shaft of electric motor 2060 and sprocket 2010 is reduced at reduction gear ratio R (2) to advance the phase of intake valve 1100.

When the phase of intake valve 1100 is to be retarded, the output shaft of electric motor 2060 is rotated relative to sprocket 2010 in the direction opposite to the direction in the case where the phase thereof is to be advanced. As in the case of advancing the phase, when the phase is to be retarded and the phase of intake valve 1100 is in the first region between the most retarded angle and CA (1), the rotational speed of relative rotation between the output shaft of electric motor 2060 and sprocket 2010 is reduced at reduction gear ratio R (1) and the phase is retarded. Further, when the phase of intake valve 1100 is in the second region between CA (2) and the most advanced angle, the rotational speed of relative rotation between the output shaft of electric motor 2060 and sprocket 2010 is reduced at reduction gear ratio R (2) and the phase is retarded.

Accordingly, as long as the direction of the relative rotation between the output shaft of electric motor 2060 and sprocket 2010 is the same, the phase of intake valve 1100 can be advanced or retarded for both of the first region between the most retarded angle and CA (1) and the second region between CA (2) and the most advanced angle. Here, for the second region between CA (2) and the most advanced angle, the phase can be more advanced or more retarded. Thus, the phase can be changed over a wide range.

Further, since the reduction gear ratio is high for the first region between the most retarded angle and CA (1), a large torque is necessary for rotating the output shaft of electric motor 2060 by a torque acting on intake camshaft 1120 as engine 1000 operates. Therefore, even if electric motor 2060 generates no torque as in the case where electric motor 2060 is stopped, rotation can be restrained of the output shaft of electric motor 2060 caused by the torque acting on intake camshaft 1120. Therefore, a change of the actual phase from a phase determined under control can be restrained. Moreover, a phase-change that is not intended can be restrained when power supply to electric motor 2060 as the actuator is stopped.

In the chase where the phase of intake valve 1100 is in the third region between CA(1) and CA(2), the rotational speed of relative rotation between the output shaft of electric motor 2060 and sprocket 2010 is reduced at a reduction gear ratio that changes at a predetermined rate of change, which may result in advance or retard in phase of intake valve 1100.

Accordingly, in the case where the phase changes from the first region to the second region or from the second region to the first region, the amount of the phase-change with respect to the rotational speed of relative rotation between the output shaft of electric motor 2060 and sprocket 2010 can be increased or decreased gradually. In this way, a sudden stepwise change of the amount of the phase-change can be restrained to thereby restrain a sudden change in phase. Accordingly, the capability to control the phase can be improved.

As discussed above, the intake VVT mechanism for the variable valve timing apparatus in the present embodiment provides, in the case where the phase of the intake valve is in the region from the most retarded angle to CA (1), reduction gear ratio of intake VVT mechanism 2000 as a whole is R (1). When the phase of the intake valve is in the region from CA (2) to the most advanced angle, the reduction gear ratio of intake VVT mechanism 2000 as a whole is R (2), which is lower than R (1). Thus, as long as the rotational direction of the output shaft of the electric motor is the same, the phase of the intake valve can be advanced or retarded for both of the regions, namely the first region between the most retarded angle and CA (1) and the second region between CA (2) and the most advanced angle. Here, for the second region between CA (2) and the most advanced angle, the phase can be advanced or retarded to a greater extent. Therefore, the phase can be changed over a wide range. Further, for the first region between the most retarded angle and CA (1), the reduction gear ratio is high and therefore it is possible to prevent rotation of the output shaft of the electric motor by the torque acting on the intake camshaft as the engine is operated. Thus, a change of the actual phase from a phase determined under control can be restrained. Accordingly, the phase can be changed over a wide range and the phase can be controlled accurately.

Now, a control structure for the phase of intake valve 1100 (hereinafter, also simply referred to as an intake valve phase) will be described in detail.

Figure 11:
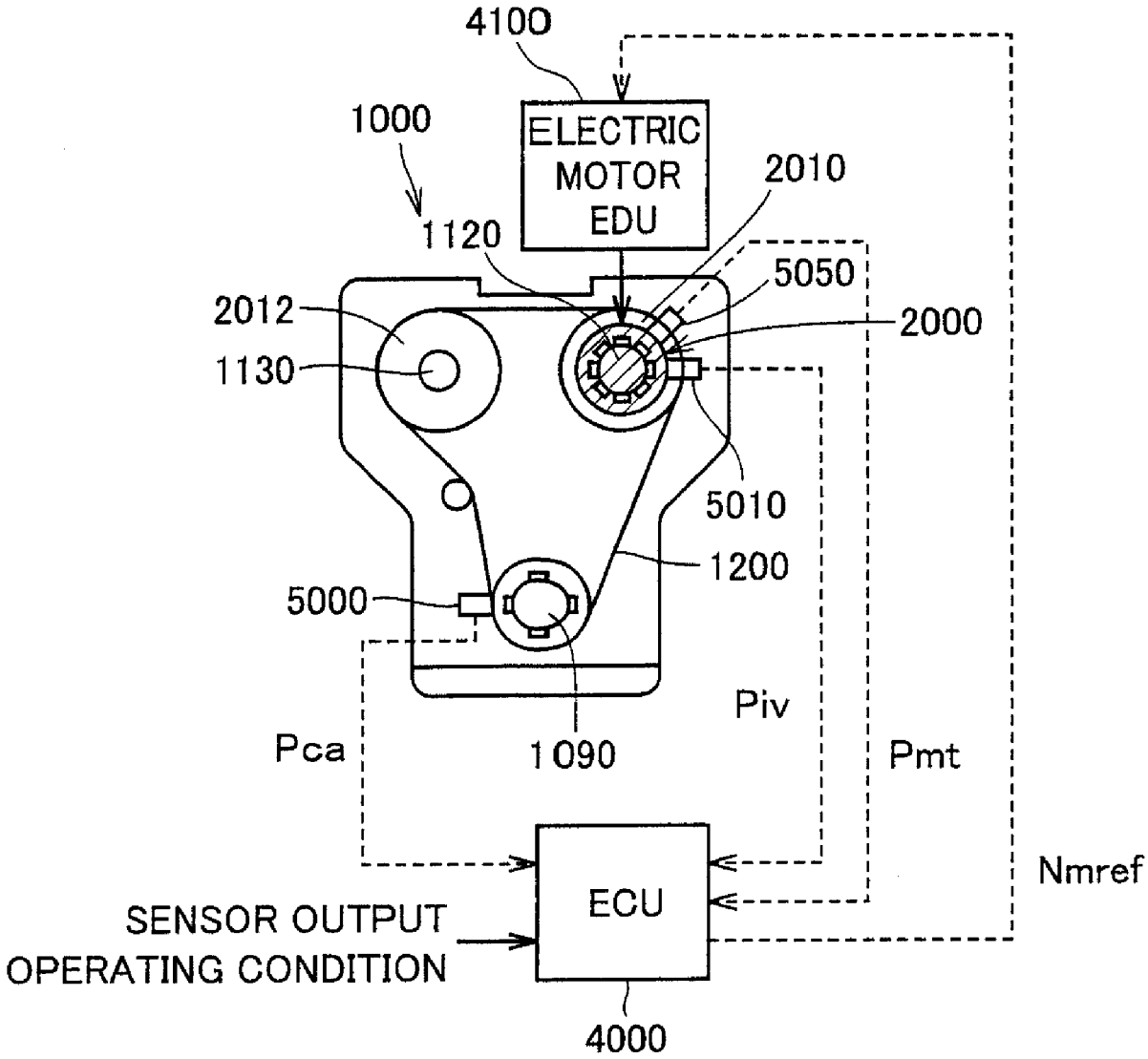
FIG. 11 is a schematic block diagram illustrating a control structure for an intake valve phase using the variable valve timing apparatus in accordance with the present embodiment.

Referring to FIG. 11, as illustrated in FIG. 1, engine 1000 is configured such that power from crankshaft 1090 is transmitted by a timing chain 1200 (or timing belt) to intake camshaft 1120 and exhaust camshaft 1130 through respective sprockets 2010, 2012. Further, cam position sensor 5010 outputting a cam angle signal Piv for each prescribed cam angle is attached on the outer circumference of intake camshaft 1120. On the other hand, crank angle sensor 5000 outputting a crank angle signal Pca for each prescribed crank angle is attached on the outer circumference of crankshaft 1090. In addition, motor rotational angle sensor 5050 outputting a motor rotational angle signal Pmt for each prescribed rotational angle is attached to a rotor (not shown) of electric motor 2060. Cam angle signal Piv, crank angle signal Pca and motor rotational angle signal Pmt are input to ECU 4000.

Further, ECU 4000 controls the operation of engine 1000 so that an output requested for engine 1000 is obtained, based on the outputs from the sensors for detecting a state of engine 1000 and the operating condition (driver pedal operation, current vehicle speed, and the like). As part of the engine control, ECU 4000 sets a target value (target phase) of the respective phases of intake valve 100 and exhaust valve 1110.

In addition, ECU 4000 generates a rotational speed command value Nmref of electric motor 2060 as an actuator for intake VVT mechanism 2000 so that the phase of intake valve 1100 matches the target phase. Rotational speed command value Nmref is determined corresponding to the rotational speed of the output shaft of electric motor 2060 relative to sprocket 2010 (intake camshaft 1120). The difference in rotation speed of electric motor 2060 relative to intake camshaft 1120 corresponds to the actuator operation amount. An electric motor EDU (Electronic Drive Unit) 4100 controls the rotational speed of electric motor 2060 according to rotational speed command value Nmref from ECU 4000.

Here, during the course of engine stop, specifically after generation of a command to stop engine 1000, the target value of the valve phase (target phase) is set to a valve phase suitable for engine start, in preparation for the next engine start. Therefore, in the case where the intake valve phase at the time of engine stop differs from the target phase suitable for engine start (the phase has not reached the target phase), the variable valve timing apparatus need to change the intake valve phase (that is, the phase of intake camshaft 1120) after the time of engine stop.

Figure 12:
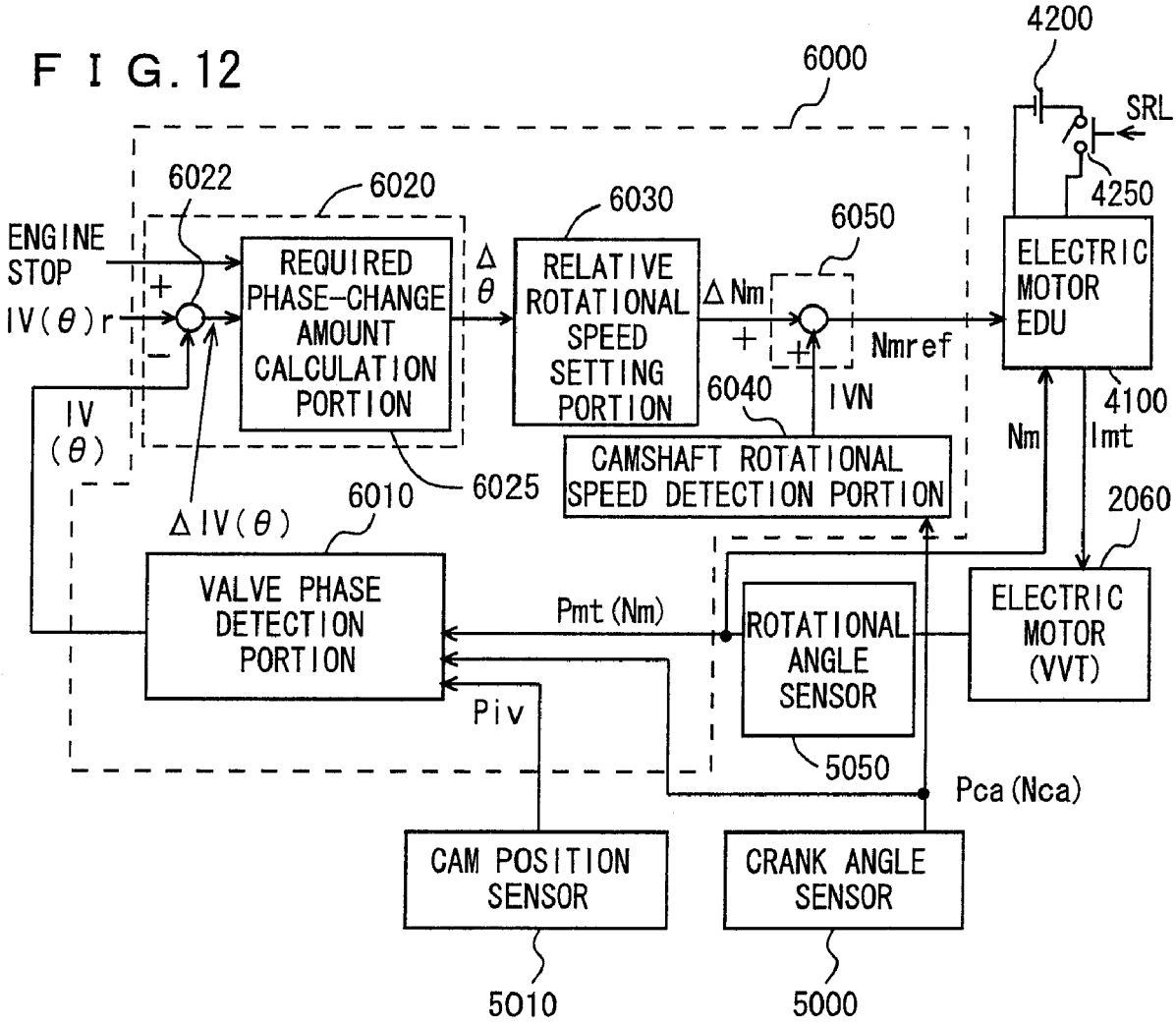
FIG. 12 is a block diagram illustrating rotational speed control for an electric motor as an actuator of the variable valve timing apparatus in accordance with the present embodiment.

FIG. 12 is a block diagram illustrating rotational speed control for electric motor 2060 as the actuator for intake VVT mechanism 2000 in accordance with the embodiment of the present invention.

Referring to FIG. 12, an actuator operation amount setting portion 6000 includes a valve phase detection portion 6010, a camshaft phase-change amount calculation portion 6020, a relative rotational speed setting portion 6030, a camshaft rotational speed detection portion 6040, and a rotational speed command value generation portion 6050. The operation of actuator operation amount setting portion 6000 is realized by executing a control process according to a prescribed program stored in ECU 4000 in advance, for each prescribed control period.

Valve phase detection portion 6010 calculates an actual phase IV(θ) of intake valve 1100 at present (hereinafter, also referred to as "actual intake valve phase IV(θ)") based on crank angle signal Pca from crank angle sensor 5000, cam angle signal Piv from cam position sensor 5010 and motor rotational angle signal Pmt from rotational angle sensor 5050 of electric motor 2060.

Valve phase detection portion 6010 calculates the present phase of intake camshaft 1120, namely the actual intake valve phase, for example, by converting, at the time of generation of cam angle signal Piv, the time difference of cam angle signal Piv from the generation of crank angle signal Pca into the rotational phase difference between crankshaft 1090 and intake camshaft 1120, based on crank angle signal Pca and cam angle signal Piv (a first phase calculation method).

Alternatively, in intake VVT mechanism 2000 in accordance with the embodiment of the present invention, based on the operation amount of electric motor 2060 as an actuator (relative rotational speed ΔNm), the phase-change amount of the intake valve can be traced accurately. Specifically, the actual relative rotational speed ΔNm is calculated based on the output from each sensor, and then the amount of change dIV(θ) of the actual intake valve phase per unit time (every control period) is calculated through an operation process according to the expression (1) as described later based on the calculated actual relative rotational speed ΔNm. Therefore, valve phase detection portion 6010 can also calculate the present phases of intake camshaft 1120, namely the actual intake valve phases one by one also by integrating the amount of change dIV(θ) of the actual phase (a second phase calculation method).

Valve phase detection portion 6010 can detect the actual intake valve phase IV (θ) by using the first and second phase calculation methods as indicated above as appropriate, in consideration of the stability in engine speed, the operation load, and the like, For example, the second phase calculation method as indicated above is used to secure the phase detection accuracy in an unstable engine speed region, specifically in a region of a relatively low rotational speed (for example, in a region of a rotational speed lower than 1000 rpm), while the first phase calculation method as indicated above is used to detect the phase in a high engine speed region where the engine speed is stable and the interval between the cam angle signals is short, thereby preventing increase in operation load of ECU 4000.

Camshaft phase-change amount calculation portion 6020 has a calculating portion 6022 and a required phase-change amount calculation portion 6025. Calculating portion 6022 finds a phase deviation ΔIV(θ) of actual intake valve phase IV(θ) from target phase IV(θ)r (ΔIV(θ)=IV(θ)−IV(θ)r). Required phase-change amount calculation portion 6025 calculates a required phase-change amount Δθ for intake camshaft 1120 in this control period, according to the phase deviation ΔIV(θ) found by calculating portion 6022.

For example, a maximum value Δθ max of phase-change amount Δθ in a single control period is preset, so that required phase-change amount calculation portion 6025 determines phase-change amount Δθ according to the phase deviation ΔIV(θ) in the range of the maximum value Δθ max. Here, the maximum value Δθ max may be a prescribed fixed value. Alternatively, required phase-change amount calculation portion 6025 may set the maximum value Δθ max variably according to the operating state of engine 1000 (rotational speed, intake air quantity, and the like) or the magnitude of phase deviation ΔIV(θ). Further, as described in detail below, camshaft phase-change amount calculation portion 6020 makes a convergence determination of whether or not the actual phase-change amount IV(θ) has reached the target phase IV(θ)r, and at the time of phase convergence, sets phase-change amount Δθ=0.

Relative rotational speed setting portion 6030 calculates the rotational speed ΔNm of the output shaft of electric motor 2060 relative to the rotational speed of sprocket 2010 (intake camshaft 1120), which is required to produce required phase-change amount Δθ obtained by required phase-change amount calculation portion 6025. For example, the relative rotational speed ΔNm is set at a positive value (ΔNm>0) when the intake valve phase is to be advanced. By contrast, the relative rotational speed ΔNm is set at a negative value (ΔNm<0) when the intake valve phase is to be retarded, and the relative rotational speed ΔNm is set at approximately 0 (ΔNm=0) when the present intake valve phase is to be maintained (namely, at the time of phase convergence where Δθ=0).

Here, the relation between the phase-change amount Δθ and the relative rotational speed ΔNm per unit time ΔT corresponding to the control period is represented by the following expression (1). It is noted that in the expression (1), R(θ) is a reduction gear ratio which varies according to the intake valve phase as shown in FIG. 9.

$$\Delta\theta \propto \Delta Nm \cdot 360° \cdot (1/R(\theta)) \cdot \Delta T \quad (1)$$

Accordingly, relative rotational speed setting portion 6030 can find relative rotational speed ΔNm of electric motor 2060 for producing camshaft phase-change amount Δθ required in control period ΔT, through an operation process according to the expression (1).

Camshaft rotational speed detection portion 6040 obtains the rotational speed of sprocket 2010, namely the actual rotational speed IVN of intake camshaft 1120, as being half the rotational speed of crankshaft 1090. Here, camshaft rotational speed detection portion 6040 may be configured to calculate the actual rotational speed IVN of intake camshaft 1120 based on cam angle signal Piv from cam position sensor 5010. Here, the number of outputs of the cam angle signal per revolution of intake camshaft 1120 is generally smaller than the number of outputs of the crank angle signal per revolution of crankshaft 1090, and therefore the detection accuracy can be improved by detecting the camshaft rotational speed IVN based on the rotational speed of crankshaft 1090.

Rotational speed command value generation portion 6050 performs an addition of the actual rotational speed IVN of intake camshaft 1120 obtained by camshaft rotational speed detection portion 6040 and the relative rotational speed ΔNm set by relative rotational speed setting portion 6030 to generate rotational speed command value Nmref for electric motor 2060. The rotational speed command value Nmref generated by rotational speed command value generation portion 6050 is sent to electric motor EDU 4100.

Electric motor EDU 4100 is connected to a power source 4200 through a relay circuit 4250. The on/off of relay circuit 4250 is controlled by a control signal SRL. Power source 4200 is generally formed of a secondary battery rechargeable at the time of engine operation. Therefore, the valve phase (namely, the camshaft phase) can be changed by continuously turning on relay circuit 4250 using a timer 6070 even after engine stop to operate electric motor 2060 as the actuator for a prescribed period of time.

Electric motor EDU 4100 controls the rotational speed such that the rotational speed of electric motor 2060 matches rotational speed command value Nmref. For example, electric motor EDU 4100 controls switching of a power semiconductor device (for example, transistor) so that supply power (typically, motor current Imt) from power source 4200 to electric motor 2060 is controlled according to a rotational speed deviation (Nref−Nm) of actual rotational speed Nm of electric motor 2060 from rotational speed command value Nmref For example, a duty ratio in the switching operation of such a power semiconductor device is controlled.

In particular, electric motor EDU 4100 controls duty ratio DTY which is the amount of adjustment in rotational speed control, in order to improve motor controllability.

$$DTY=DTY(ST)+DTY(FB) \quad (2)$$

In the expression (2), DTY (FB) is a feedback term based on a control operation (typically, general P control, PI control, or the like) using the above-noted rotational speed deviation and prescribed control gain.

Figure 13:
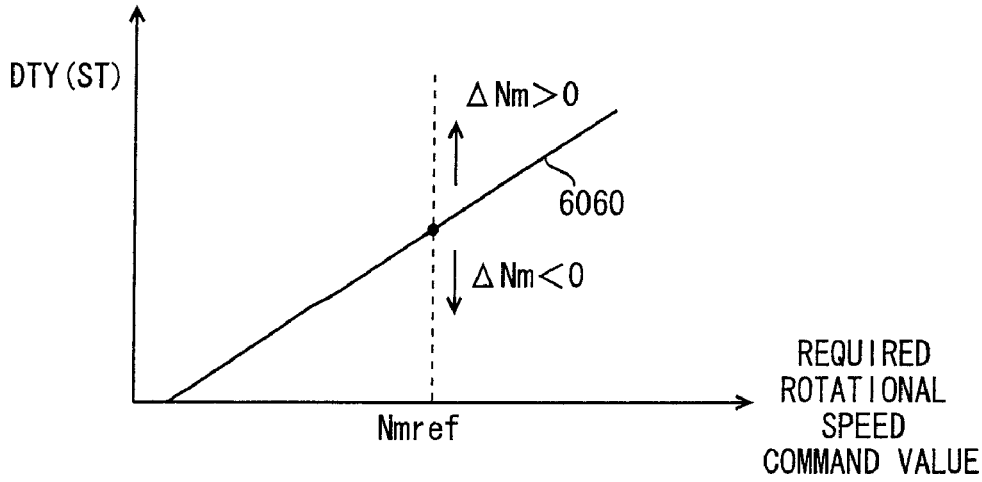
FIG. 13 schematically shows speed control for the electric motor.

DTY (ST) in the expression (2) is a preset term set based on the rotational speed command value Nmref and the set relative rotational speed ΔNm of electric motor 2060 as shown in FIG. 13.

Referring to FIG. 13, a duty ratio characteristic 6060 is represented in a table beforehand, which is associated with the motor current value required when the relative rotational speed ΔNm=0, that is, when electric motor 2060 rotates at the same rotational speed as sprocket 2010 (ΔNm=0) with respect to rotational speed command value Nmref Then, DTY (ST) in the expression (2) is set by relatively increasing/decreasing the electric current value corresponding to the relative rotational speed ΔNm, from the reference value depending on duty ratio characteristic 6060. Because of the rotational speed control in which supply power to electric motor 2060 is controlled with a combination of the preset term and the feedback term in this manner, electric motor EDU 4100 allows the rotational speed of electric motor 2060 to follow a change in rotational speed command value Nmref at high speed, as compared with a simple feedback control, that is, the rotational speed control only using the DTY (FB) term in the expression (2).

(Convergence Determination of Intake Valve Phase Control According to Embodiment of the Present Invention)

Figure 14:
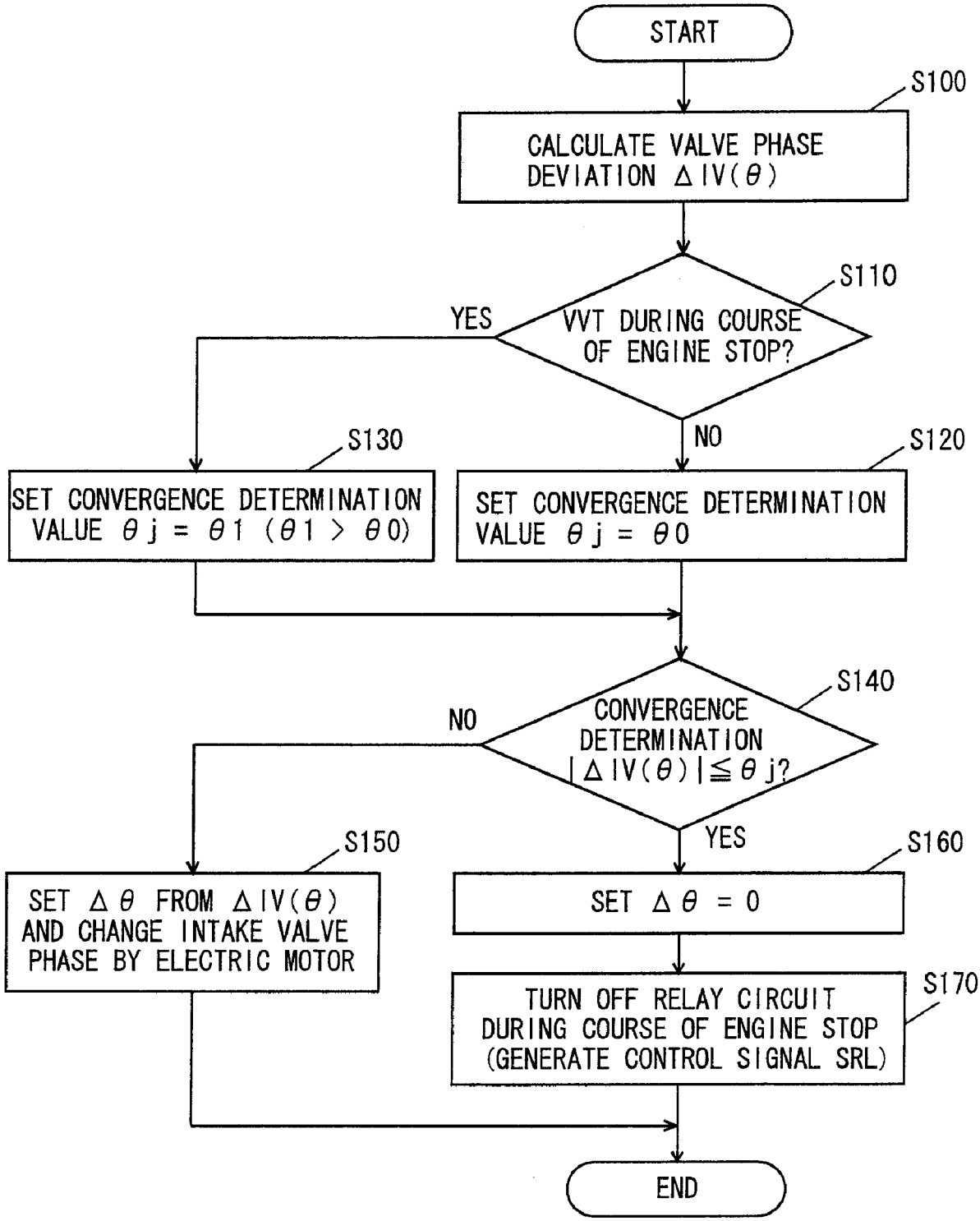
FIG. 14 is a flowchart illustrating a target value convergence determination in the intake valve phase control in the variable valve timing apparatus in accordance with the embodiment of the present invention.

In the embodiment of the present invention, a convergence determination of the intake valve phase control is made according to the flowchart shown in FIG. 14. The convergence determination according to the flowchart in FIG. 14 is made by ECU 4000 as part of the valve timing control by intake VVT mechanism 2000.

ECU 4000 finds a phase deviation ΔIV(θ) of the actual intake valve phase IV(θ) from the target phase IV(θ)r, at step S100. In other words, the process at step S100 corresponds to an operation of operation portion 6022 (FIG. 12). ECU 4000 additionally determines whether the intake valve phase control is the one during the course of engine stop, at step S110.

For example, the determination at step S110 is YES after generation of a command to stop engine 1000, while the determination at step S110 is NO before generation of the command. In this case, in response to generation of the engine stop command, in a prescribed period of time including a period during a process of engine stop for reducing the engine speed to a stop state (engine speed=0) and a period after the engine is actually stopped, it is determined that "the intake valve phase control is the one during the course of engine stop (YES at step S110)." Here, the engine stop command is not limited to the one generated in response to the driver's switch operation and may be generated by the engine automatic stop control in hybrid vehicles or vehicles equipped with so-called eco-run system. More specifically, although the intake valve phase control during the course of engine stop is generally started from an idle speed state, it may be started from a state where the engine speed is the idle speed or higher for example by the automatic stop control as described above.

Alternatively, the determination at step S110 may be YES in a period after the engine is actually stopped, according to the actual engine speed.

If NO at step S110, namely in the intake valve phase control at the time of engine operation, ECU 4000 sets a convergence determination value θj=θ0, at step S120. This determination value θ0 is set corresponding to the intake valve phase accuracy required for the engine control during operation.

On the other hand, if YES at step S110, namely in the intake valve phase control during the course of engine stop, ECU 4000 sets the conversion determination value θj =θ1, at step S130. This determination value θ1 is set at a value relatively larger than the determination value θ0 at the time of engine operation. Here, since the valve timing change during the course of engine stop is made in preparation for the next engine start as mentioned above, the requested intake valve phase accuracy is lower than at the time of engine operation. Therefore, the determination value can be set as indicated above.

ECU 4000 makes a conversion determination at step S140 by comparing the absolute value of the phase deviation ΔIV (θ) obtained at step S110 with the conversion determination value set at step S120 or S130.

If the phase deviation |ΔIV(θ)|>θj (if NO at step S140), ECU 4000 determines that the actual intake valve phase IV(θ) has not yet reached the target phase IV(θ)r, namely that the intake valve phase control has not yet converged, and then required phase-change amount calculation portion 6025 (FIG. 12) sets the phase-change amount Δθ according to the phase deviation ΔIV(θ) (step S150). Electric motor 2060 is operated according to the phase-change amount Δθ set in this manner so that the intake valve phase is further changed to the target phase.

On the other hand, if the phase deviation |ΔIV(θ)|≦θj (if YES at step S140), ECU 4000 determines that the actual intake valve phase IV(θ) has reached the target phase IV(θ)r, namely that the intake valve phase control has converged, and then required phase-change amount calculation portion 6025 (FIG. 12) sets the phase-change amount Δθ=0 (step S160). Accordingly, the relative rotational speed of electric motor 2060 corresponding to the actuator operation amount is set as ΔNm=0.

At the time of engine stop when the rotational speed of intake camshaft 1120 and crankshaft 1090 is zero, if the relative rotational speed ΔNm=0 is set, the rotational speed command value of electric motor 2060 is set as Nmref=0. At the time of engine stop, the target phase IV(θ)r basically has a fixed value, and therefore, the operation of electric motor 2060 is stopped after the convergence of the intake valve phase control. The operation of electric motor 2060 can be stopped by generating control signal SRL or controlling electric motor EDU 4100 so as to stop the power supply to electric motor 2060.

As a result, in the intake valve phase control during the course of engine stop, after the actual intake valve phase IV(θ) reaches the target phase, electric motor 2060 as the actuator is stopped thereby preventing unnecessary power consumption after that. In particular, in consideration of the difference in the requested intake valve phase accuracy between the course of engine stop and the time of engine operation, the convergence determination conditions are relaxed in the intake valve phase control during the course of engine stop, thereby reducing power consumption.

In the intake valve phase control during the course of engine stop, ECU 4000 typically may generate control signal SRL to turn off relay circuit 4250, at step S170. Accordingly, after the actual intake valve phase IV(θ) reaches the target phase at the time of engine stop, power supply to electric motor 2060 (actuator) is stopped, thereby preventing unnecessary power consumption after that, more reliably. In particular, a region in which the reduction gear ratio is high as shown in FIG. 9 is set to cover the target phase of the intake valve during the course of engine stop, thereby preventing an error in phase detection as the power supply to electric motor 2060 (actuator) is stopped at step S170.

Here, relay circuit 4250 (or electric motor ECU 4100) may be configured to be forcedly turned off, using a not-shown timer or the like, after a prescribed time has passed since the time of engine stop (or the time of starting the engine stop process), irrespective of whether the intake valve phase control converges or not. Because of such a configuration, in the case where the intake valve phase control does not converge for a long time due to any trouble, unnecessary increase in power consumption can be prevented.

In the foregoing embodiment, steps S140, S160 in FIG. 14 correspond to "convergence determination means (step)" in the present invention, steps S110-S130 correspond to "determination value switching means (step)" in the present invention, and step S170 corresponds to "power supply stop means (step)" in the present invention.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A variable valve timing apparatus changing an opening/closing timing of at least any one of an intake valve and an exhaust valve provided to an engine, comprising:

an actuator, a change mechanism changing said opening/closing timing by changing difference in rotational phase of a camshaft driving the valve having said opening/closing timing changed, from a rotational phase of a crankshaft, at an amount of change according to an operation amount of said actuator; and an actuator operation amount setting portion setting the operation amount of said actuator, based on a deviation between said opening/closing timing at present of the valve having said opening/closing timing changed and a target value thereof, said actuator operation amount setting portion including convergence determination means for setting the operation amount of said actuator to approximately zero, when an absolute value of said deviation is equal to or smaller than a determination value, and determination value switching means for setting, in changing said opening/closing timing during a course of engine stop, said determination value in said convergence determination means at a value larger than said determination value in changing said opening/closing timing at a time of engine operation.

2. The variable valve timing apparatus according to claim 1, further comprising power supply stopping means for stopping power supply to said actuator when the absolute value of said deviation becomes equal to or smaller than the determination value, in changing said opening/closing timing during the course of engine stop.

3. The variable valve timing apparatus according to claim 1, wherein said actuator is formed of an electric motor and the operation amount of said actuator is a rotational speed difference of said electric motor relative to said camshaft, and said change mechanism changes said opening/closing timing such that a ratio between the operation amount of said actuator and the amount of change of said opening/closing timing differs and a change direction of said opening/closing timing is identical, between a case where said opening/closing timing is in a first region and a case where said opening/closing timing is in a second region.

4. The variable valve timing apparatus according to claim 1, wherein in changing said opening/closing timing during a course of stopping said engine, the target value of said opening/closing timing is set at a prescribed value suitable for a next engine start.

5. A variable valve timing apparatus changing an opening/closing timing of at least any one of an intake valve and an exhaust valve provided to an engine, comprising:

an actuator;

a change mechanism changing said opening/closing timing by changing difference in rotational phase of a camshaft driving the valve having said opening/closing timing changed, from a rotational phase of a crankshaft, at an amount of change according to an operation amount of said actuator; and a control unit setting the operation amount of said actuator, based on a deviation between said opening/closing timing at present of the valve having said opening/closing timing changed and a target value thereof, wherein said control unit sets the operation amount of said actuator to approximately zero, when an absolute value of said deviation is equal to or smaller than a determination value, and in addition, in changing said opening/closing timing during a course of engine stop, sets said determination value at a value larger than said determination value in changing said opening/closing timing at a time of engine operation.

6. The variable valve timing apparatus according to claim 5, wherein said control unit gives an instruction to stop power supply to said actuator when an absolute value of said deviation becomes equal to or smaller than the determination value, in changing said opening/closing timing during the course of engine stop.

7. The variable valve timing apparatus according to claim 5, wherein said actuator is formed of an electric motor and the operation amount of said actuator is a rotational speed difference of said electric motor relative to said camshaft, and said change mechanism changes said opening/closing timing such that a ratio between the operation amount of said actuator and the amount of change of said opening/closing timing differs and a change direction of said opening/closing timing is identical, between a case where said opening/closing timing is in a first region and a case where said opening/closing timing is in a second region.

8. The variable valve timing apparatus according to claim 5, wherein in changing said opening/closing timing during a course of stopping said engine, the target value of said opening/closing timing is set at a prescribed value suitable for a next engine start.

9. A control method of a variable valve timing apparatus changing an opening/closing timing of at least any one of an intake valve and an exhaust valve provided to an engine, said variable valve timing apparatus including an actuator, a change mechanism changing said opening/closing timing by changing difference in rotational phase of a camshaft driving the valve having said opening/closing timing changed, from a rotational phase of a crankshaft, at an amount of change according to an operation amount of said actuator, and an actuator operation amount setting portion setting the operation amount of said actuator, based on a deviation between said opening/closing timing at present of the valve having said opening/closing timing changed and a target value thereof, said control method comprising:

a convergence determination step of setting the operation amount of said actuator to approximately zero, when an absolute value of said deviation is equal to or smaller than a determination value; and a determination value switching step of setting, in changing said opening/closing timing during a course of engine stop, said determination value at said convergence determination step at a value larger than said determination value in changing said opening/closing timing at a time of engine operation.

10. The control method of a variable valve timing apparatus according to claim 9, further comprising a power supply stopping step of stopping power supply to said actuator when an absolute value of said deviation becomes equal to or smaller than the determination value, in changing said opening/closing timing during the course of engine stop.

11. The control method of a variable valve timing apparatus according to claim 9, wherein said actuator is formed of an electric motor and the operation amount of said actuator is a rotational speed difference of said electric motor relative to said camshaft, and said change mechanism changes said opening/closing timing such that a ratio between the operation amount of said actuator and the amount of change of said opening/closing timing differs and a change direction of said opening/closing timing is identical, between a case where said opening/closing timing is in a first region and a case where said opening/closing timing is in a second region.

12. The control method of a variable valve timing apparatus according to claim 9, wherein in changing said opening/closing timing during a course of stopping said engine, the target value of said opening/closing timing is set at a prescribed value suitable for a next engine start.

* * * * *